US005515562A

United States Patent [19]

Miller et al.

[11] Patent Number: 5,515,562

[45] Date of Patent: May 14, 1996

[54] SACRAL AND PERINEAL PADS

[75] Inventors: Kenneth A. Miller; Darrell G. Hill, both of Edina; Shelly Perpich, Minneapolis, all of Minn.

[73] Assignee: Health Care Solutions, Inc., Edina, Minn.

[21] Appl. No.: 265,403

[22] Filed: Jun. 24, 1994

[51] Int. Cl.[6] ..... A61G 13/12

[52] U.S. Cl. ..... 5/624; 5/632; 5/648; 606/243

[58] Field of Search ..... 5/630, 632, 636, 5/643, 648, 650, 652, 600, 624; 606/241–244

[56] References Cited

U.S. PATENT DOCUMENTS

| | | | |
|---|---|---|---|
| 2,085,296 | 6/1937 | Carey | 5/630 |
| 2,933,738 | 4/1960 | Whelan | 5/630 |
| 3,158,878 | 12/1964 | Pernell | 5/630 |
| 3,430,272 | 3/1969 | Thorn, Jr. | 5/100 |
| 4,236,265 | 12/1980 | Carradine | 5/630 |
| 4,391,438 | 7/1983 | Heffington, Jr. | 5/632 |

*Primary Examiner*—Alexander Grosz

*Attorney, Agent, or Firm*—Patterson & Keough

[57] ABSTRACT

The present invention provides for perineal and sacral padding of a patient undergoing surgical procedures using manipulation or traction of the patient's lower extremities.

12 Claims, 1 Drawing Sheet

SACRAL AND PERINEAL PADS

FIELD OF THE INVENTION

This invention relates to pads for use during surgical procedures and particularly pads for protecting the patient's sacral and perineal areas.

BACKGROUND OF THE INVENTION

Surgical procedures often require the use of general anesthesia rendering a patient unconscious and unable to care for himself. The operating room personnel must accordingly provide adequate care and protection of the patient's person and that responsibility is heightened because of the patient's unconscious. Specific aspects of the patient's person requiring attention are bony prominences, joints, neurovascular bundles traversing limbs, and dependent portions of the patient's body.

Some surgical procedures, for example, intra-abdominal surgery, require that only the limbs and dependent portions of the patient's back be protected. During these types of procedures, the patient is positioned once and no further positive action beyond adequate protection is required, because the patient will not be moved during the surgical procedure. Some procedures, however, particularly orthopaedic procedures, require not only initial positioning of a patient's body coupled with adequate protection, but will also involve intra-operative maneuvering and manipulation of the patient and patient's limbs.

It is during procedures involving patient manipulation, including traction, where injury to a patient's person is more likely to occur. As force is applied to a limb for traction and manipulation, some other portion of the patient must be stabilized against that traction force. The portions of the patient's body involved in exerting the traction force may be inadvertently injured if not adequately protected.

Procedures involving traction of the lower limbs are particularly fraught with potential for injury to the patient. Examples of such procedures involving traction and manipulation include total hip replacements, partial hip replacements, open reduction and internal fixation of femoral head fractures, open reduction and internal fixation of femoral neck fractures, open reduction and internal fixation of femoral trochanteric fractures, open reduction and closed reduction and internal fixation of femoral shaft fractures, and open reduction and closed reduction with internal or external fixation of tibial shaft fractures. A patient undergoing such procedures is placed on a specialized surgical support frame known as a fracture table in order to obtain the necessary traction. The patient's torso, from the pelvis and sacrum to the head, is placed on a table-like surface, with the lower extremities of the patient suspended by additional appendages extending from the surgical table or frame. The lower limb requiring the traction is placed into a traction harness and traction is applied along the axis of the limb. A pubic post extends up from the table surface to engage the patient's pelvis at the crotch in order to maintain the patient on the table and prevent the patient from being pulled off by the traction.

Considerable force is often exerted on an affected lower extremity by traction devices, and this force is transmitted to the patient's pubic and sacral area as the patient's body is pulled into the fracture table pubic post anchoring device. Unfortunately, it is not an uncommon occurrence for patients to be injured in the perineal and sacral areas by the application of the traction, with the attendant pressure applied by the pubic post. Within the perineal area, injury to the pudendal nerve, scrotum and penis of the male, labia and urethra of the female, and the ischial tuberosity of the pelvis can occur by compression or impaction of the pubic post against the patient. Injuries in the sacral area also commonly involve compression sores and skin breakdown, known as decubitus ulcers.

Surgical frames and tables have in the past been provided with protective pads. The pads, however, are shaped to fit the table surface, not the patient. Operating room personnel have, in general, been obliged to use jury-rigged padding in the form of folded or wrapped towels placed between the patient and the pubic post. As will be appreciated, towels were not intended or designed for this purpose; and the padding effect provided has been minimal. Moreover, most orthopaedic procedures using a fracture table with traction subject the patient to considerable stress, motion, and manipulation during the procedure. This motion and manipulation in conjunction with traction often times causes make shift padding to slip or fall away from its intended position, exposing the patient to considerable injury. Additionally, during the surgical procedure the patient's lower body and extremities are draped as part of the sterile technique employed by operating room personnel to minimize post-operative surgical infections. Therefore, once a patient is positioned and draped it becomes virtually impossible to reassess the patient's positioning and padding during the surgical procedure without breaking sterile technique.

A pubic post pad is available on the open market from Action Products, Inc. The Action Product pad is a gel filled square pad that is partially wrapped around a pubic post. This pad is designed to cover only a portion of the post and, if it inadvertently rotates during a surgical procedure, the patient will have no padding protection. The Action Product pubic post pad does not provide any sacral protection.

It would be advantageous to have a sacral pad and a pubic post pad designed to adequately protect the patient during all surgical procedures regardless of the degree of traction force applied, manipulation or maneuvering the patient is subjected to during the surgical procedure.

SUMMARY OF THE INVENTION

The present invention addresses the above outlined unique problems with surgical table fixture padding for protecting a patient during a surgical procedure. The surgical table fixture padding hereof includes a cylindrical pad suitable for a friction fit over a traction post. The invention also discloses a sacral pad having a shape substantially conforming to that of a patient and providing substantially effective protection to a patient's sacrum during a surgical procedure. The sacral pad includes an anchoring mechanism for anchoring the sacral pad to the pubic post so that the sacral pad will remain in apposition to the patient's sacrum between the patient and the top of the surgical table.

Both the cylindrical pad and the sacral pad are made from resilient elastomeric material, for example a high grade medical grade foam, that can be constructed with varying degrees of compression. One type of medical grade foam is constructed using polyurethane. The elastomeric material is preferably non-allergenic, non-toxic, bacteriostatic, and meets or exceeds federal fire codes for use in surgical suites. The pads may be disposable or reusable. The components of the pads are sealable within an appropriate covering that is likewise non-allergenic, non-toxic, bacteriostatic, and meets fire codes for use in a surgical suite. The covering may be hermetically sealable and fluid impervious to provide for reusability.

DETAILED DESCRIPTION

Figure 1:
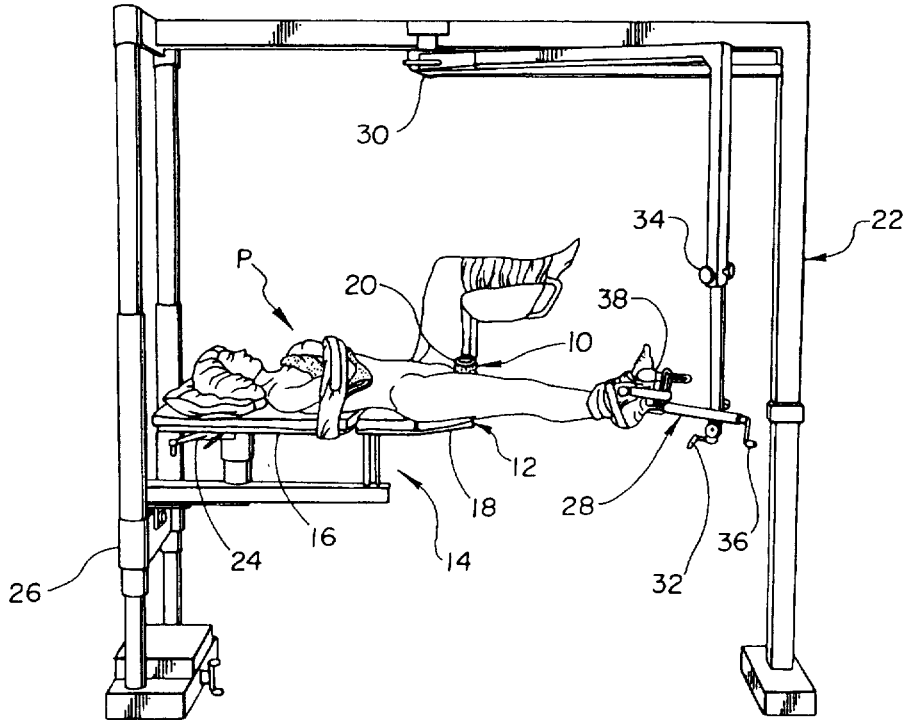
FIG. 1 is a perspective view of a fracture table and traction assembly with a patient depicted in an appropriate position for traction application, and with a traction post pad and sacral pad in accordance with the present invention in place covering the sacral seat and traction post of the fracture table.

A cylindrical pad 10 and a sacral pad 12, in accordance with the present invention, are depicted in FIG. 1 as installed on a fracture table 14.

The fracture table 14 includes a table top 16, a sacral seat 18 and a traction post 20. Fracture table 14, as depicted, also includes a traction frame 22 and a table top tilt control 24. Traction frame 22 includes a table top height control 26 and a traction arm 28. Traction arm 28 further includes a lateral swing pivot 30, an arm height control 32, a height control lock 34, a traction control 36, and a lower extremity limb attachment means 38. A patient P is depicted in FIG. 1 as positioned supine on table top 16 and sacral seat 18 so that the patient's perineum rests against post pad 10 and the patient's sacral area is resting over sacral pad 12.

When a patient is positioned on table top 16 and sacral seat 18, the patient's affected limb may be placed into traction using traction arm 28. As depicted in FIG. 1, the patient's foot on the lower extremity to be operated on is mounted securely into attachment means 38 on the end of traction arm 28. The height of the table top is adjusted to place the operating field, for example the hip of the patient, at the appropriate height for the surgeon using table top height control 26. Now the affected limb can be manipulated through the controls on traction arm 28. Traction is applied through traction control 36. The angle of the limb in relation to the patient's trunk may be varied. The affected limb may be moved laterally or medially through pivot 30. Height of the limb may be adjusted using height control 32. The patient may be placed in a positive or negative tilt with tilt control 24. A fracture table such as fracture table 14 provides considerable latitude in patient maneuvering and limb manipulation.

As traction is applied to the affected limb with traction control 36, the affected limb is distracted along the axis of the limb. The force of the traction draws the patient's pelvis into traction post 20 bringing the patient's perineum against post pad 10. The weight of the patient's pelvis at the sacral surface is supported by sacral pad 12. At times, traction vectors applied to the affected limb exert an additional downward force on the limb, over and above the pressure applied to the sacrum by gravity. This increase in pressure is evident if the patient is placed in a negative, head down orientation, or if the arm height control 32 places the foot of the affected limb lower than the patient's hip. When this occurs, the traction force, which is transmitted to the pelvis, increases the pressure exerted on the patient's sacral surface. This additional sacral pressure is compensated for by sacral pad 12.

Figure 2:
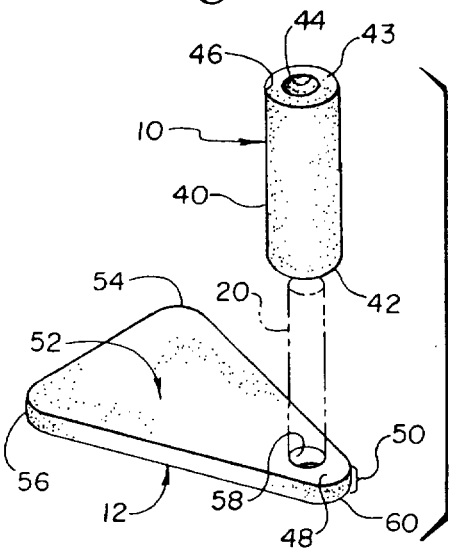
FIG. 2 is a perspective view illustrating a traction post pad and sacral pad according to the present invention, with phantom lines depicting a traction post.

Post pad 10 and sacral pad 12 are designed to compensate for the pressures exerted by the patient's body providing the patient safety and protection from possible injury to the patient's perineal and sacral areas. Referring to FIG. 2, post pad 10 includes a cylindrical outer surface 40, a first end 42, a second end 43, and a cylindrical inner surface 44. The distance between surface 40 and surface 44 presents a pad thickness 46. The first end 42 may be fashioned to provide suitable abuttable engagement of sacral pad 12. The resilient elastomeric material density, grade and load deflection used in construction of post pad 10 are factors determining thickness 46. A medical grade foam, for example 1.8 foam with 48° load deflection of compression (ILD), is one type of resilient elastomeric material suitable for this invention.

Sacral pad 12, as depicted in FIG. 2, is of a generally planar construction with an upper surface 48, a lower surface 49, and an outer margin 50. Sacral pad 12 also includes a body portion 52, a posterior superior iliac spine prominence support lobe 54, 56 and an anchoring cylindrical surface 58 at apical end 60. Upper surface 48, in the region of anchoring cylindrical surface 58, is adapted to abuttably receive first end 42 of cylindrical pad 10. The resilient elastomeric material density, grade and load deflection used in construction of sacral pad 12 are factors determining thickness of pad 12 as measured between upper surface 48 and lower surface 49. Body portion 52 is designed to support a patient's midline sacral prominence. Posterior superior iliac spine prominence support lobes 54, 56 are designed to provide support to a patient's posterior superior iliac spines. The general thickness of sacral pad 12 may vary through body portion 52 and support lobes 54, 56 at the time of construction depending on the resilient elastomeric material density, grade and load deflection used. A medical grade foam, for example 1.8 foam with 48° load deflection (ILD) of compression, is one type of resilient elastomeric material suitable for this invention.

Figure 4:
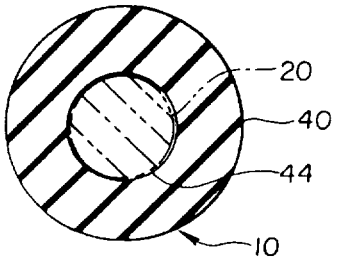
FIG. 4 is a cross sectional view taken along the line 4—4 of FIG. 3.
Figure 3:
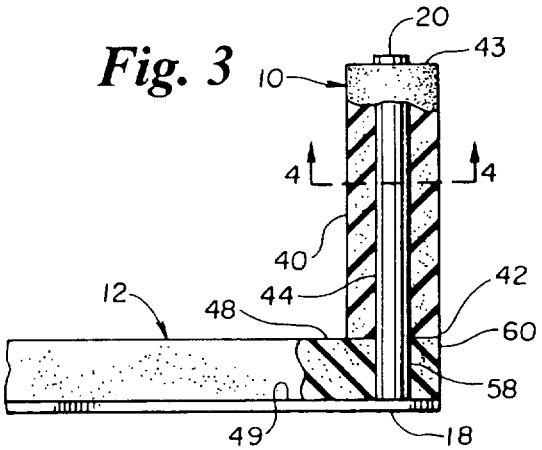
FIG. 3 is a fragmentary, side elevational view depicting the traction post and surgical table top of a fracture table with a traction post pad and sacral pad in accordance with the invention installed thereon, and with parts cut away for clarity.

Deployment of post pad 10 and sacral pad 12 in relationship to traction post 20 and surgical table sacral seat 18 is depicted in FIGS. 3 and 4. In FIG. 3, sacral pad 12 is placed over traction post 20 so that anchoring cylindrical wall 58 slides over traction post 20 with upper surface 48 opposite sacral seat 18. Anchoring cylindrical wall 58 provides an anchoring mechanism for sacral pad 12 by maintaining the position of sacral pad 12 in relation to traction post 20. If the patient is maneuvered during the procedure, anchoring cylindrical wall 58 provides for pivoting of sacral pad 12 at traction post 20. This pivoting of sacral pad 12 ensures that as the patient's sacrum moves, the sacrum remains on sacral pad 12.

Post pad 10 slides over traction post 20 until first end 42 rests against and abuttably engages upper surface 48. A cross sectional view of post pad 10 is depicted in FIG. 4 showing the relationship of post pad 10 to traction post 20 where inner cylindrical surface 44 is of a diameter sufficient to just fit over the traction post 20. The cylindrical construction of post pad 10 provides for rotation of post pad 10 around traction post 20. When a patient is maneuvered, the cylindrical construction provides for protection of a patient's perineal area by post pad 10 rotating with the patient's motion.

The pads may also be placed within suitable coverings for reusable application. The covering material should preferably be fluid impervious, washable and sterilizable. If the covering is to be removable, the covering should preferably provide a hermetic seal when the pads are placed within the covering.

With the present invention, traction on a patient's affected lower extremity can be safely applied during a surgical procedure. Furthermore, the patient may be draped by the operating room personnel without trepidation that post pad 10 or sacral pad 12 will be inadequate to support the patient or manipulated away from their appropriate relative positions to the patient's body.

We claim:

1. A surgical table lower body traction padding system for protecting a patient during surgery, the patient positioned supine on top of a surgical table for applying traction to the patient's lower body such that the patient's pelvis is generally supported by a sacral seat portion having a traction post thereon for applying counter traction force to the patient's perineum and pelvis, the padding system comprising:

a resilient elastomeric material sacral pad having an upper and lower surface, a traction post engaging wall structure defining an aperture suitable for slidable engagement with the surgical table traction post and a generally planar triangular configuration suitable for substantially encompassing a patient's sacral prominence and posterior superior iliac spines; and a resilient elastomeric material cylindrical pad having a first and second end and a central cylindrical wall defining a central bore suitable for slidable engagement with the surgical table traction post and the first end suitable for engagement with the sacral pad upper surface, whereby the sacral pad is slidably positioned over the traction post so that the lower surface is adjacent the sacral seat portion and the cylindrical pad is slidably positioned over the post and the cylindrical pad first end is in frictional abuttable engagement with the sacral pad upper surface, such that positioning the patient on the surgical table places the sacral pad between the patient's sacrum and the surgical table top surface and positions the cylindrical pad between the patient's perineum and the traction post during the surgery.

2. The system of claim 1 further comprising a fluid impervious, washable and sterilizable covering for substantially wrapping around the padding system.

3. The system of claim 2 in which the covering is removable from the padding system.

4. The system of claim 2 in which the padding system is sealed within the covering.

5. The system of claim 1 in which the padding comprises a resilient elastomeric material having a minimum load deflection of 48 ILD.

6. The system of claim 1 in which the padding comprises resilient elastomeric material that is non-toxic, non-allergenic, bacteriostatic and substantially fire resistant.

7. A padding for a surgical table fixture having a surgical table traction post adapted for protecting a patient during surgery comprising:

a resilient elastomeric material sacral pad having a substantially planar configuration and of sufficient thickness including:

an inner cylindrical wall traversing the thickness of the pad and eccentrically placed toward an edge of the pad, for slidable engagement with the surgical table traction post substantially anchoring the sacral pad; and eccentrically placed sacral prominence protection lobes, the pad slidably positioned over the surgical table traction post and frictionally engaging a top surface of the surface table so that the sacral pad is positioned between the patient's sacrum and the surgery table top; and a resilient elastomeric material cylindrical pad having an inner longitudinally placed cylindrical wall defining a central bore for slidable engagement with said surgical table traction post, said cylindrical pad adapted for slidable positioning over the traction post such that the pad is positioned between the patient and the traction post.

8. The device of claim 7 in which the fixture padding further comprises a fluid impervious, washable and sterilizable covering for wrapping substantially around the sacral and cylindrical pads.

9. The device of claim 8 in which the covering is removable from the sacral and cylindrical pads.

10. The device of claim 8 in which the sacral and cylindrical pads are sealed within the covering.

11. The device of claim 7 in which the resilient elastomeric material sacral and cylindrical pads comprise a resilient elastomeric material having a minimum load deflection of 48 ILD.

12. The device of claim 7 in which the resilient elastomeric material sacral and cylindrical pads comprise resilient elastomeric material that is non-toxic, non-allergenic, bacteriostatic and substantially fire resistant.

* * * * *